US006802354B2

(12) United States Patent
Bouveresse

(10) Patent No.: US 6,802,354 B2
(45) Date of Patent: Oct. 12, 2004

(54) HAND-HELD DEVICE FOR THE APPLICATION OF A TOTAL TAPE ONTO A SUBSTRATE

(75) Inventor: Jeanne-Antide Bouveresse, Rueil Malmaison (FR)

(73) Assignee: Societe BIC (FR)

( * ) Notice: Subject to any disclaimer, the term of this patent is extended or adjusted under 35 U.S.C. 154(b) by 0 days.

(21) Appl. No.: 10/226,234

(22) Filed: Aug. 23, 2002

(65) Prior Publication Data

US 2003/0024653 A1 Feb. 6, 2003

Related U.S. Application Data

(63) Continuation of application No. PCT/EP01/01534, filed on Feb. 12, 2001.

(30) Foreign Application Priority Data

Feb. 25, 2000 (EP) ..... 00103993

(51) Int. Cl.[7] ..... B32B 31/00

(52) U.S. Cl. ..... 156/522; 156/523; 156/527; 156/577; 156/579; 118/76; 242/160.4; 242/171; 242/588.6; 225/23; 225/56

(58) Field of Search ..... 156/523, 577, 156/574, 579, 527, 238, 540, 522; 242/588.2, 588.6, 160.2, 160.4, 588, 588.3, 170, 171; 225/46, 23, 56, 91; 118/200, 257, 76

(56) References Cited

U.S. PATENT DOCUMENTS

| | | | | |
|---|---|---|---|---|
| 2,755,953 A | | 7/1956 | Vogt | 216/33 |
| 3,369,951 A | | 2/1968 | Fritzinger | 156/523 |
| 3,865,671 A | * | 2/1975 | Kronsder | 156/488 |
| 4,345,966 A | | 8/1982 | Iiyama et al. | 156/523 |
| 4,486,263 A | * | 12/1984 | Monzo Gomez | 156/523 |
| 4,648,935 A | * | 3/1987 | Brown et al. | 156/577 |
| 5,076,883 A | | 12/1991 | Bosley | 156/522 |
| 5,207,860 A | * | 5/1993 | Klaassen et al. | 156/526 |
| 5,244,161 A | * | 9/1993 | Wirtz-Odenthal | 242/560.1 |
| 5,707,482 A | | 1/1998 | Fusselman | 156/577 |

FOREIGN PATENT DOCUMENTS

| | | | |
|---|---|---|---|
| DE | 21 50 239 | 4/1972 | |
| EP | 0 297 060 | 12/1988 | 7/2 |
| EP | 42 17 294.2 | 12/1993 | 11/6 |
| JP | 10-330021 | 12/1998 | 35/7 |
| WO | WO 97/12827 | 4/1997 | |

* cited by examiner

*Primary Examiner*—Richard Crispino
*Assistant Examiner*—Cheryl N. Hawkins

(57) ABSTRACT

A hand-held device for applying correction tape on an application surface having at most only a supply spool for a stock of the correction tape. An applicator element, which can be a roller, applies the correction tape in its entirety on the application surface. No backing tape or the like is rewound back into the casing. Therefore, a second take-up spool can be omitted. In the vicinity of the application element a cut-off/separating element is provided for cutting off or separating the applied correction tape from the rest of the correction tape when lifting the device off an application surface.

37 Claims, 6 Drawing Sheets

HAND-HELD DEVICE FOR THE APPLICATION OF A TOTAL TAPE ONTO A SUBSTRATE

CROSS-REFERENCE TO RELATED APPLICATIONS

The present application is a continuation of U.S. National Stage designation of co-pending International Patent Application PCT/EP01/01534, filed on Feb. 12, 2001, which claims priority to European Patent Application 00 103 993.2, filed Feb. 25, 2000. The entire content of both these applications is expressly incorporated herein by reference thereto.

FIELD OF THE INVENTION

The invention relates to a device for applying on a surface a correction tape having an application side and a write-on side, to a correction tape adapted to be used in such a device, as well as to a correction tape.

BACKGROUND OF THE INVENTION

Hand-held devices for applying a correction tape on a surface or hand-held correction device (referenced herein as a tape applicator for the sake of convenience without any intent to limit), typically comprise a casing in which two spools are housed. One of the spools serves as a supply spool for the correction tape and the second spool serves as a take-up spool for a backing portion of the tape which is fed back into the casing. The correction tape is guided around an application tip which is pressed against an application surface (usually paper) in operation to apply a coating of the correction tape on said surface. Therefore, the application element separates the correction coating layer from the backing tape. The correction coating layer is adhesive such that it sticks fixedly on the application surface.

At the beginning, the known tape applicators had quite large dimensions. As such, they were quite cumbersome for the user to operate. Therefore, it had always been the general trend to reduce the outer dimensions of the casing of hand-held devices in an ergonomic way. A pen shape is supposed to be ideal as users are used to such a shape. The lower limit for the dimensions of the casing of a hand-held correction device are determined by the size of the spools and the tape dimensions, particularly the length of the tape. As for a commercial product, a certain minimum length of the correction tape is required, there are correspondingly lower limits for the dimensions, i.e., the diameter of the spools.

Further, it is to be noted that, according to the prior art, a backing tape is used for the correction tape, the thickness of the correction tape can be hardly further reduced.

A tape applicator as described above is for example known from WO97/12827. This known tape dispenser has a housing accommodating a tape. The tape consists of a carrier ribbon carrying a coating of a composition. The housing also accommodates used carrier ribbon from which the composition has been removed. The supply of tape is held in elongated rear wound around a pair of spaced apart and independently rotatable spool members. In known correction tape applicators, generally separate tape supply and take up spools are provided within the casing, and the two spools are linked by a drive mechanism so that a tape is drawn for use from the supply spool, and the take up spool is rotated to wind up the used carrier ribbon or backing tape. Also, as the rotational speeds of the spools are not the same, some form of clutch mechanism is usually demanded. The need for a clutch mechanism further increases the manufacturing costs which is a disadvantage, especially as most tape applicators are intended to be discarded after the initial tape supply has been used up. Because when first manufactured and used essentially all the tape is carried by the supply spool, whereas at final use the supply spool is empty and all the carrier ribbon is wound onto the take up spool, the respective spools require considerable space within the casing which also serves as a handle for the tape applicator during use. Consequently, the length of tape which can be supplied in a tape applicator is limited if the body is not to become large and, as a result, make the tape applicator cumbersome and inconvenient to use. This drawback is especially acute where it is designed to provide a tape applicator with a slim elongated body or handle to enable it to be held similar to a way in which a pen or marker is held in the hand.

SUMMARY OF THE INVENTION

The present invention provides for a technique allowing for a dimensional reduction of the casing of a hand-held correction device by omitting the separation of the correction coating layer and the backing tape at the application tip or element. As there is no backing tape separated from the correction coating layer at the application element, there is no requirement for feeding back a backing tape into the casing and therefore a take-up spool, as required in the prior art, can be omitted.

Moreover, in accordance with the principles of the present invention a hand-held device for applying a correction tape on a surface is provided with correction tape that has an application side and a write-on side.

The device may include a cut-off/separating element in the vicinity of the application element for cutting-off/separating the correction tape once the application operation is completed. The cut-off/separating device is operative when the device is lifted off the application surface and inoperative when the device is pressed against the application surface.

The cut-off/separating device is positioned slightly behind the contact region of the application element on the application surface.

The application element and the cut-off/separating device can be displaceable relative to each other such that they can assume a first inoperative position in which they are distanced from each other, as well as a second operative position in which they are in contact with each other with the correction tape interposed therebetween.

A mechanism can be provided for advancing the correction tape from a cutoff/separating position to the contact region of the application element before use of the device. The tape advancing mechanism can be operated manually. The application element can be a roller.

The bearing axis of the roller can be elastically displaceable in a direction being essentially perpendicular to the application surface during operation of the device.

In the lift-off state of the device, the roller can be biased against the cutoff/separating device.

The correction tape can be guided around the portion of the circumference of the roller.

The surface of the roller can be such that the correction tape sticks on it in a releasable manner. At least the surface region of the roller can be made of rubber or similar material. Additionally, or alternatively, the back side of the tape can be such that it sticks on the application element in a releasable manner.

The stock of the correction tape can be wound on a supply spool and a braking force can be applied to the supply spool to prevent slacking of the correction tape.

The bearing of the supply spool can be designed such as to exert a braking force on the supply spool.

The supply spool can be arranged on the rear side of the casing.

According to another aspect, a correction tape for a hand-held device adapted to be used in a device as said forth above is proposed.

According to still another aspect of the present invention, a correction tape for a hand-held correction device is proposed having a first side and a second side, the first side being an application side or layer and the other side being a write-on side or layer.

Additionally, a reinforcing intermediate layer can be interposed between the application layer and the write-on layer.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1A:
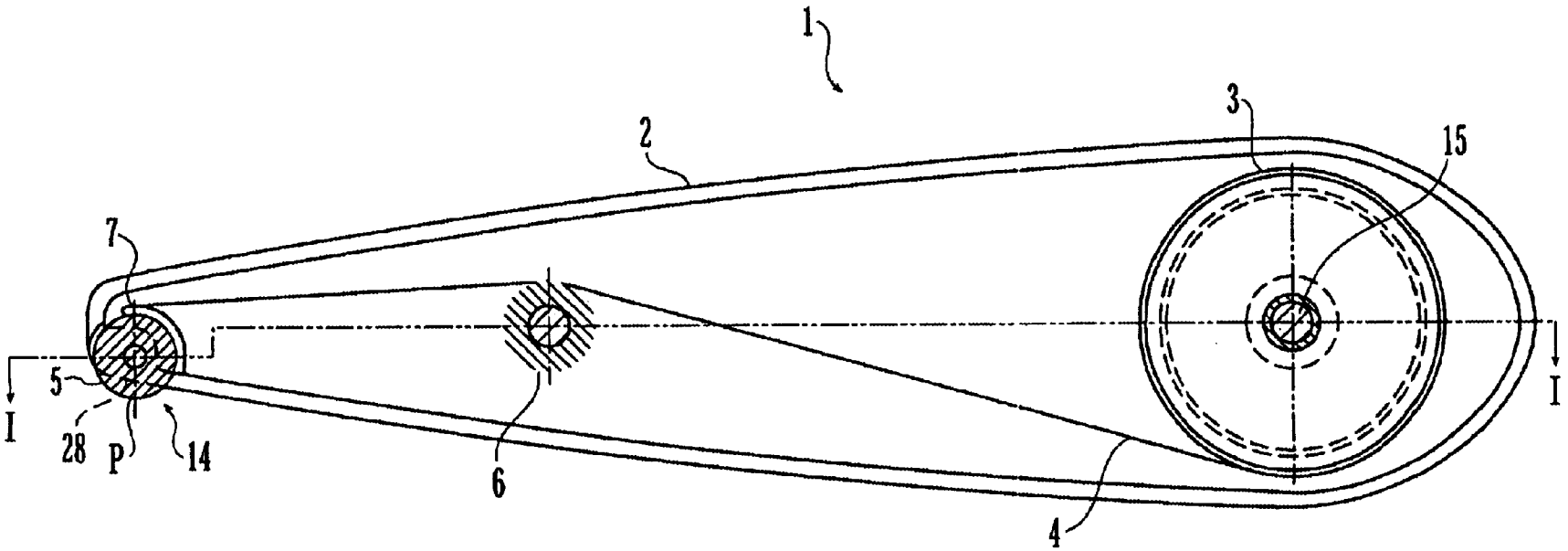
FIG. 1*a* is an overall sectional view of an embodiment of the present invention.

Embodiments of the invention are described below by referring to the drawings. Exemplary hand-held correction devices formed in accordance with the principles of the present invention are illustrated in FIG. 1*a* through FIG. 4, in which same reference numbers refer to similar constituent components or elements.

As can be seen from FIG. 1*a*, hand-held correction device 1 serves to apply correction tape 4 by means of an application element, which is in the form of a roller 5. A stock of correction tape 4 is wound on supply spool 3, which is the only tape-carrying spool in the pen-shaped casing 2 of device 1. Supply spool 3 is fixed by means of a bearing 15 in the rear side of the compartment defined by casing 2. Tape 4 is guided from supply spool 3 over a support or guiding roller 6 to application roller 5, which extends from an aperture 14 of casing 2 of device 1. At application roller 5, correction tape 4 is deflected by means of a tape guide or guiding element 7, such that correction tape 4 is guided around a substantial portion of the circumference of application roller 5 before reaching contact region P. Contact region P is defined as being the region in which application roller 5 contacts an application surface when device 1 is held ergonomically by a user's hand, for example at an angle of 45° with respect to an application surface.

In the present embodiment, the stock of correction tape 4 is wound on supply spool 3. Alternatively, the stock can be provided in any other way, such as for example, on an elongated, pressed supply spool as described in DE 42 17 294.2. Furthermore, the stock of correction tape 4 can be, for example, zigzag folded in the rear side of casing 2 (See FIG. 1*c*). Therefore, according to the present invention it is not even necessary to provide any spool within casing 2 of device 1. Due to the possibility of a complete lack of any spool, the dimensions of device 1 can be further reduced.

Figure 1B:
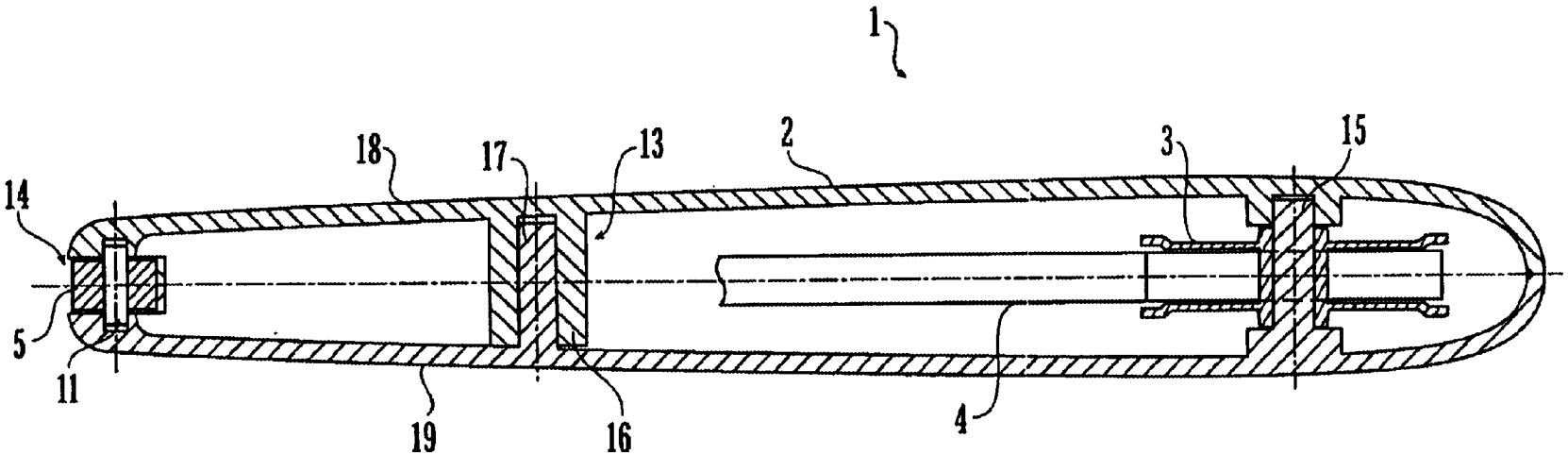
FIG. 1*b* is a sectional view of the embodiment of FIG. 1*a*.
Figure 1C:
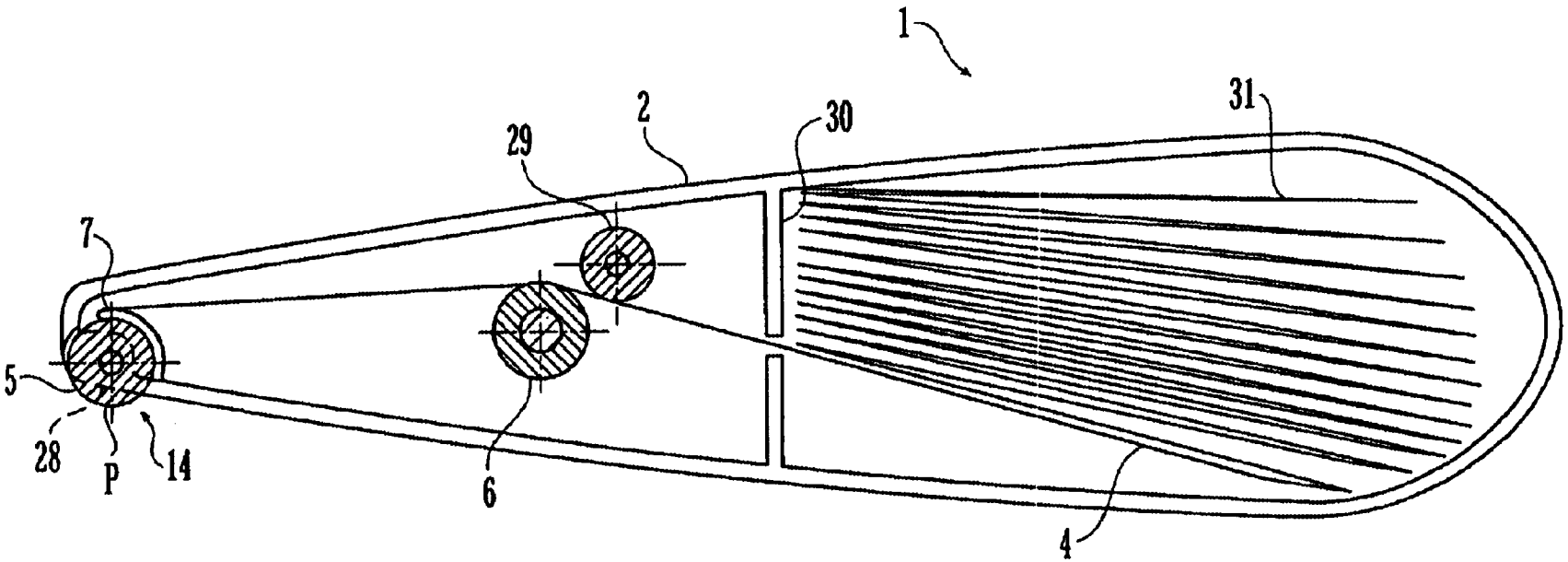
FIG. 1*c* is an overall sectional view of another embodiment of the present invention, in which the stock of correction tape is zigzag folded in the rear of the casing.

FIG. 1*c* shows such an embodiment according to which the stock 31 of correction tape 4 is housed in a compartment 30 within the casing 2. As can be seen from FIG. 1*c*, the stock 31 of correction tape 4 is zigzag folded so that a supply spool is no longer necessary. A braking force can be applied on correction tape 4 by means of braking roller 29 slightly pressing against guiding roller 6.

As illustrated in the embodiment of FIG. 1*a*, device 1 and tape 4 are designed such that correction tape 4 can be applied in its entirety by application roller 5 on an application surface. Note that there is no portion of correction tape 4 which is fed back into casing 2 of device 1 after the application. Further, there is no separation performed by, for example, applicator roller 5 to separate a prior art backing tape from a correction layer coating during the application process.

As illustrated in the embodiment of FIG. 1*a*, a hand-held device 1, according to the present invention, can be made in the shape and the dimension of, for example, a common marker pen. This is due to two reasons. The first reason is that a take-up spool can be omitted. The second reason is that by the elimination of the prior art backing tape the thickness of correction tape 4 can be considerably reduced, such that the resulting diameter of a certain length of the stock of correction tape 4 wound on supply spool 3 can be dramatically reduced.

From FIG. 1*b*, it can be seen that casing 2 of device 1 is essentially composed of two portions or halves 18, 19 fitted together during the assembly process. Bearing axis 15 for supply spool 3 can be an integral part of one of portions 18, 19 of casing 2.

In FIG. 1*a*, the lower edge 28 of casing 2 in the region of application roller 5 is depicted by a broken line. It can be seen that only a portion of application roller 5 is exposed to the outside of casing 2, therefore delimiting the contact region P.

Instead of a guiding roller 6 shown in FIG. 1*a*, a guiding element 13 in the form of a guiding web 13, as shown in FIG. 1*b*, can be provided by congruent first and second web or extending portions 16 and 17, respectively, of first and second portions 18, 19 of casing 2. In the modification according to FIG. 1*b*, correction tape 4 is also led around guiding web 13 before it reaches applicator roller 5. In FIG. 1*b*, furthermore, cylindrical axis 11 of roller 5 can be seen.

Details of the applicator element, according to the present invention, are now explained with reference to FIGS. 2*a* and 2*b*.

Figure 2A:
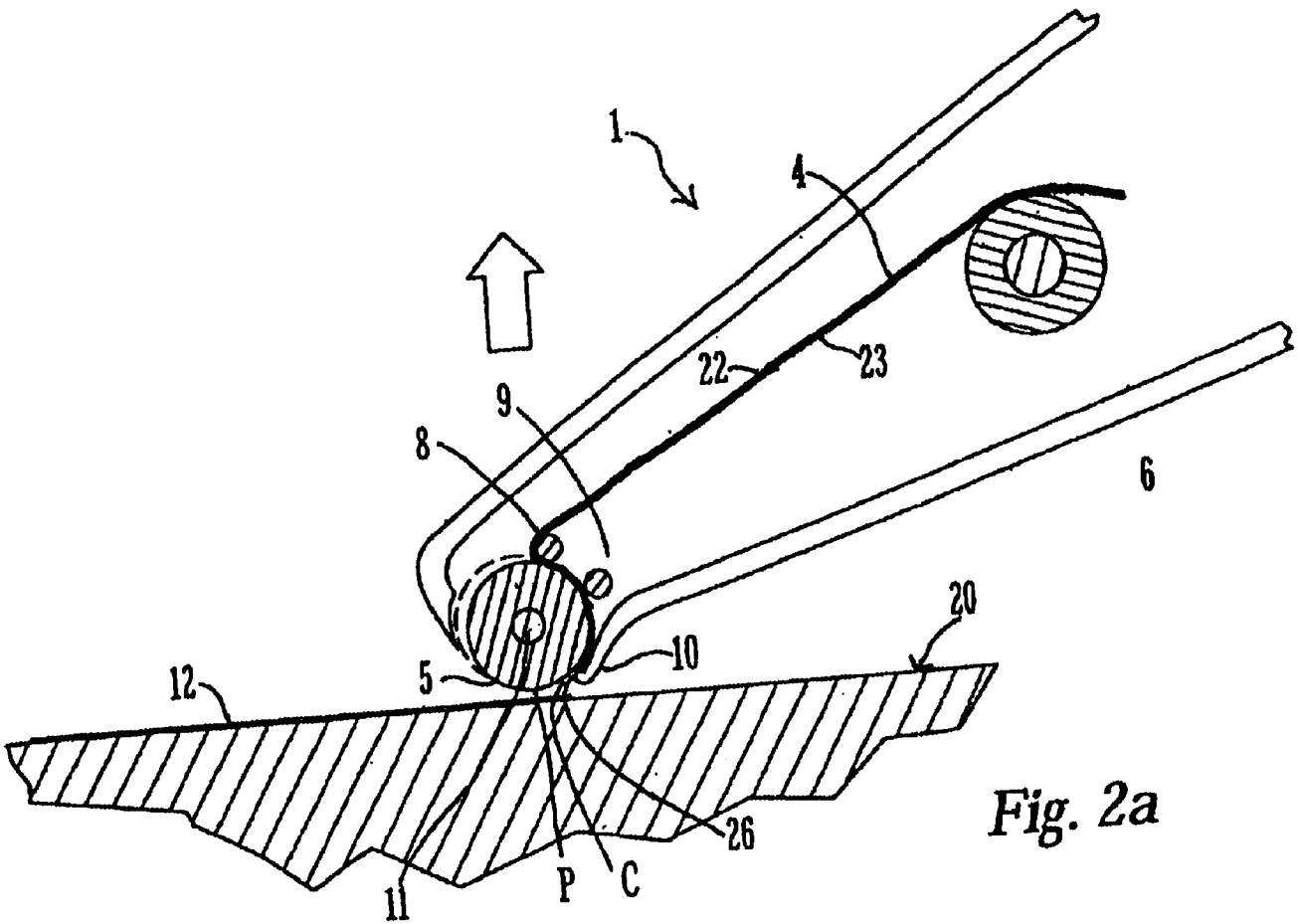
FIG. 2*a* is a detailed view of the embodiment of FIG. 1*a* in an off-lift state of the device.
Figure 2B:
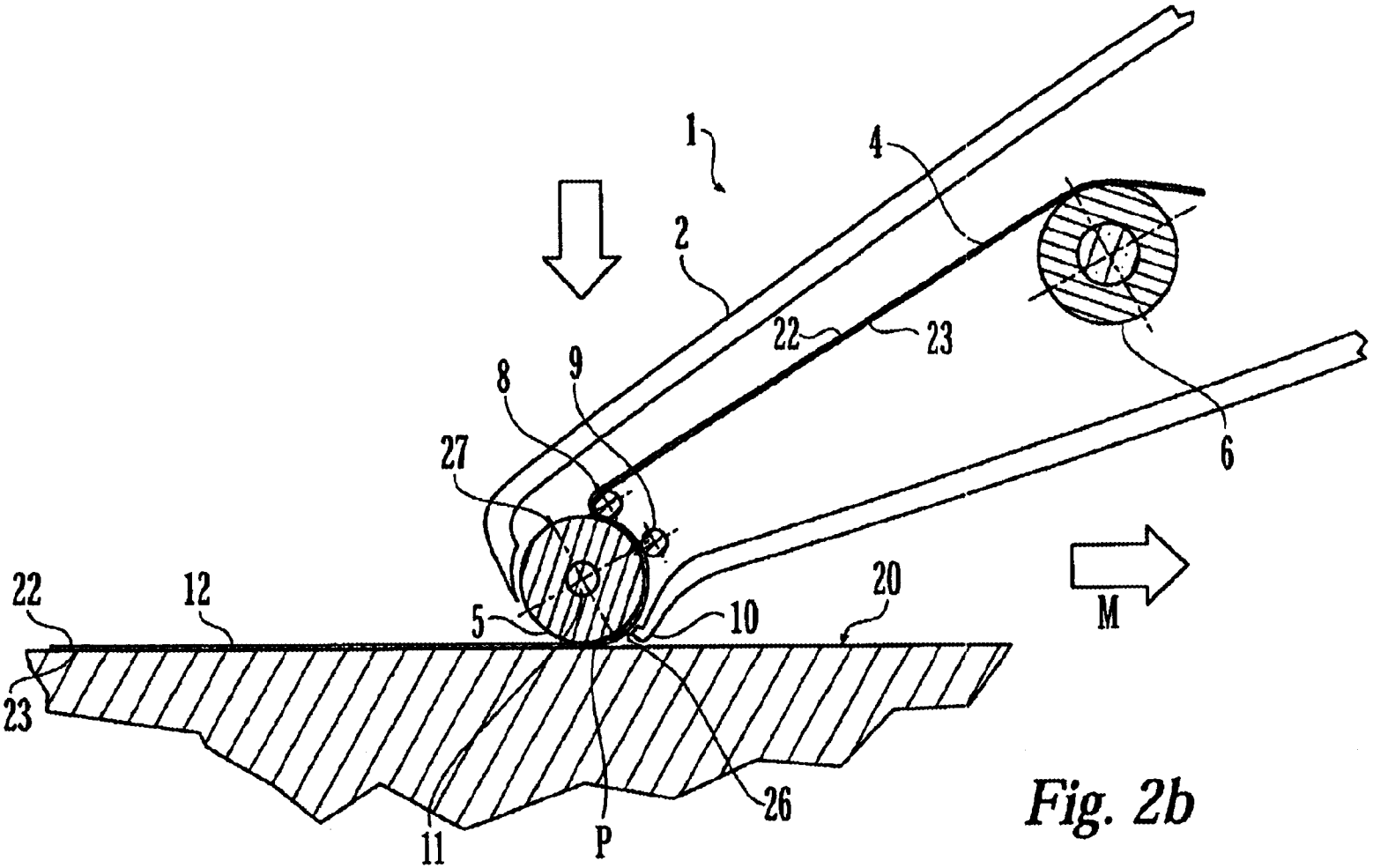
FIG. 2*b* is a detailed view of the embodiment of FIG. 1*a* in a state in which the correction device is pressed against an application surface.
Figure 3:
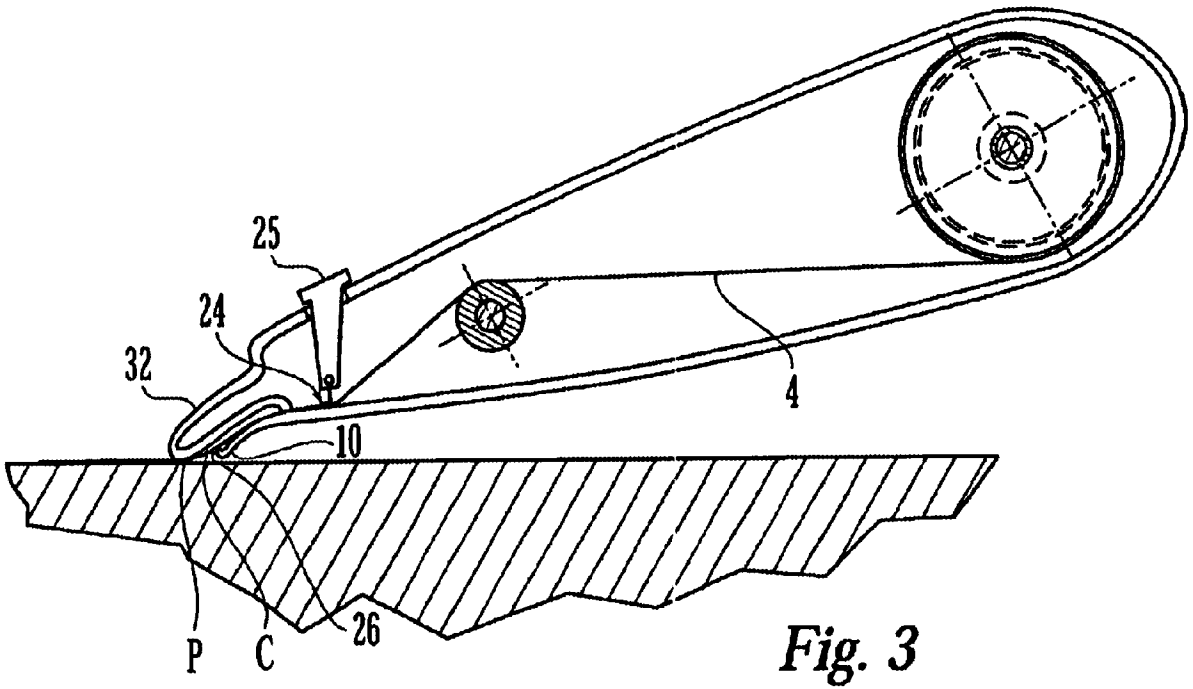
FIG. 3 is a schematic view of a further embodiment of the present invention.

As can be seen in FIGS. 2*a* and 2*b*, according to the present invention a cut-off/separating element 10 is provided. Cut-off/separating device 10 is illustrated as being in the vicinity of applicator roller 5. Such an element is not necessary in the prior art as the prior art backing tape is returned into the casing of the device. Cut-off/separation element 10 is illustrated in FIGS. 2*a*, 2*b*, and 3 (as discussed later) as being positioned slightly behind contact region P.

FIG. 2*a* shows the lift-off position of the device 1 in which applicator roller 5 is not pressed against application surface 20.

In the modification of FIG. 2*a*, correction tape 4 is guided by means of two guide rollers 8, 9 to follow the circumference of application roller 5 at least to a substantial degree.

In the lift-off position of device 1 shown in FIG. 2*a*, application roller 5 is biased against cut-off/separating device 10 having a sharp, or cut-off, or separating, or cutting edge 26 (referenced herein as a "cut-off edge 26" for the sake of convenience, without any intent to limit). Correction tape 4 is pinched in this cut-off region C between application roller 5 and cut-off edge 26 of cut-off/separating element 10.

Bearing axis 11 of application roller 5, and therefore also application roller 5 itself, is elastically displaceable relative to cut-off edge 26 of cut-off/separating element 10. The displacement may be in a direction that is essentially perpendicular to the application surface 20.

Therefore, after the application of correction tape 4 to application surface 20, when device 1 is lifted away from surface 20, application roller 5 is spring-biased against cut-off edge 26 of cut-off/separating device 10. Correction tape 4 is pinched between application roller 5 and cut-off edge 26 of cut-off/separating device 10 such that correction tape 4 is both fixed and weakened regarding its tensile strength in cut-off region C. Depending on the spring-biasing force, correction tape 4 can even be cut off in cut-off region C. Due to the weakening and/or cutting in cut-off region C, the applied tape 12 of correction tape 4 will most likely be separated from the rest of correction tape 4 in cut-off region C during the lifting-off of device 1.

As correction tape 4 is pinched in this cut-off region C, there is no risk that there will be any tension on correction tape 4 in the upstream portion thereof such that there is no risk that correction tape 4 will break further within casing 2.

Note that the cut-off region C is slightly behind contact region P in which application roller 5 is pressed against application surface 20 immediately before lifting off device 1.

As there is a small distance between cut-off region C and contact region P, correction tape 4 will have to be slightly advanced when once again using the device 1 after a lift-off. The cut off end of correction tape 4 has to be advanced from cut-off region C to contact region P by said distance between regions C and P.

According to the embodiment of FIGS. 2*a* and 2*b*, advancement of correction tape 4 is achieved in that the back side 22 sticks releasably on the circumferential surface 21 of roller 5. For example, circumferential surface 21 or the entire roller 5 can be made of rubber or a similar material. Alternatively or additionally, back side 22 of correction tape 4 can be made such that back side 22 sticks releasably on the surface of roller 5.

Therefore, when once again pressing device 1 against an application surface 20 and slightly moving device 1 in the correction direction, roller 5 will be turned by a predetermined amount, and the cut off edge of correction tape 4 will be advanced from cut-off region C to contact region P, as shown in FIG. 2*b*.

Due to the spring-biased mounting of bearing axis 11 of roller 5, correction tape 4 is released between roller 5 and cut-off edge 26 of cut-off/separating element 10 as device 1 is pressed against application surface 20, overcoming the spring biasing force. In this inoperative position of the cut-off/separating element 10, the circumferential surface 21 of roller 5 is distanced from the cut-off edge 26 although still allowing a gap large enough to let a portion of correction tape 4 sticking on circumferential surface 21 of roller 5 to freely pass through.

When once again using the device 1, as shown in FIG. 2*b*, during a predetermined length corresponding to the distance from contact region P to cut-off region C, there will be no application of correction tape 4 on surface 20. As soon as the cut off end of correction tape 4 has reached contact region P in line with the rotation of roller 5, the application process of applying correction tape 4 on application surface 20 starts immediately. Note that according to the particular construction of the application element according to the present invention, this distance between contact region P and cut-off region C can be kept very small.

To avoid any slacking of correction tape 4 within casing 2, a braking force is applied on the stock of correction tape 4 and/or supply spool 3. This can, for example, take place within bearing 15 of supply spool 3. Therefore, when applying correction tape 4 on surface 20, there will always be some tensional stress on tape 4. However, the braking force exerted on supply spool 3 is set such that the tensional stress on correction tape 4 will not exceed the tensile strength of correction tape 4.

The construction according to FIGS. 2*a* and 2*b* has the inherent advantage that correction tape 4 is automatically cut-off at cut-off edge 26 of cut-off/separating device 10 when lifting device 1 off application surface 20. Therefore, the user of device 1 does not have to undertake any further measures for cutting-off correction tape 4. Therefore, the user can naturally determine the end of the applied tape 12 by the lifting of device 1 at a selected position along surface 20.

As in the lift-off position, which is the operative state of device 1, roller 5 is spring-biased against cut-off edge 26 of cut-off/separating device 10. Thus, correction tape 4 is automatically protected against being involuntarily drawn from outside of casing 2 when device 1 is not used.

FIG. 3 shows schematically a further embodiment for a device according to the present invention. According to this embodiment, the application element is a spatula-like element 32. Further, according to this embodiment because application element 32 is not a rotatable applicator, a mechanism 24 is provided to advance the cut-off correction tape from cut-off region C to contact region P when using the device again. According to the embodiment of FIG. 3, tape advancing mechanism 24 is operated manually by means of an activation mechanism 25. Before using the device again, therefore, the user has to operate activation mechanism 25 to advance the cut off edge of correction tape 4 from cut-off region C to contact region P of the spatula-like application element 32.

Figure 4:
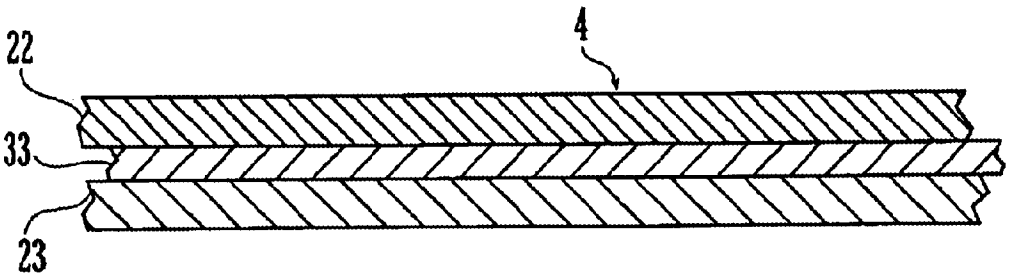
FIG. 4 is a view of the sandwich layer structure of an embodiment of a correction tape according to the present invention.

As described above, according to the present invention there is no separation of any backing tape from the correction coating layer effected by the applicator element. According to the present invention, correction tape 4 (see FIG. 4) has two sides, the first side 22 being a write-on side or layer and the second side 23 being a layer or surface being applied, e.g., adhesively fixable, on an application surface (and thus may be an adhesive side). The tensile strength of correction tape 4 can be guaranteed by write-on side 22 or application side 23 itself. Alternatively, as shown in FIG. 4, a reinforcing intermediate layer 33 can be interposed between write-on side 22 and application side 23.

List of Reference Signs

1 correction device
2 casing
3 supply spool
4 correction tape
5 applicator element (roller)
6 guiding roller
7 guiding element
8 pinch roller
9 pinch roller
10 cut-off/separation element
11 cylindrical axis of roller 5
12 applied tape
13 guiding web
14 aperture of casing 2
15 bearing axis of supply spool 3
16 first congruent web portion
17 second congruent web portion
18 first portion of casing 2
19 second portion of casing 2
20 application surface
21 surface of the roller 5
22 back side of tape 4
23 application side of tape 4
24 tape advancing mechanism
25 manual activation
26 cut-off edge
28 lower edge of casing
29 braking roller
30 compartment
31 stock of correction tape 4
32 spatula-like element
33 intermediate layer
P contact region of the application element
C cut-off/separating position

What is claimed is:

1. A device for applying on a surface a correction tape having an application side and a write-on side, the correction tape being applied in its entirety on the application surface without being fed back into the casing, said device comprising:

a casing configured for housing a stock of correction tape;

an application element extending from an aperture in said casing to press correction tape supplied from the stock on an application surface during operation of said device; and a cut-off/separating device automatically operative upon lifting said device off the application surface and inoperative when said device is pressed against the application surface to apply the application tape;

wherein said application element and said cut-off/separating device are displaceable relative to each other from a first inoperative position in which they are distanced from each other and a second operative position in which they are in contact with each other with correction tape interposed therebetween so that said tape is pinched between said application element and said cut-off/separating device.

2. A device according to claim 1, wherein said cut-off/separating device is positioned slightly behind a contact region of said application element on the application surface.

3. A device according to claim 1, further comprising a mechanism for advancing a cut off correction tape end from a cut-off/separating position to a contact region before use of the device.

4. A device according to claim 3, wherein said tape advancing mechanism is manually operated.

5. A device according to claim 1, wherein said application element is a roller.

6. A device according to claim 5, wherein said roller is mounted on a bearing axis elastically displaceable in a direction essentially perpendicular to the application surface.

7. A device according to claim 6, wherein when said device is operative, said roller is biased against said cut-off/separating device.

8. A device according to claim 5, wherein correction tape is guided around a portion of the circumference of said roller.

9. A device according to claim 8, wherein correction tape is guided by two guide rollers to follow the circumference of said roller.

10. A device according to claim 5, wherein said roller has a surface on which correction tape sticks in a releasable manner.

11. A device according to claim 10, wherein said surface of said roller is made of rubber or a rubber-like material.

12. A device according to claim 5, wherein the back side of the tape sticks on said application element in a releasable manner.

13. A device according to claim 1, wherein a braking force is applied to the supply of correction tape.

14. A device according to claim 13, further comprising a supply spool for a supply of correction tape, said spool having a bearing designed to exert a braking force on said spool.

15. A device according to claim 1, further comprising a spool for carrying correction tape arranged on the rear side of said casing.

16. A device according to claim 1, wherein said correction tape comprises an application layer, a write-on layer, and a reinforcing intermediate layer interposed between said application layer and said write-on layer.

17. A device according to claim 1, wherein said application element and said cut-off/separating device are automatically displaceable relative to each other.

18. A device according to claim 17, wherein:

during operation of said device, said application element and said cut-off/separating device are biased apart; and upon lifting said device off said application surface, said application element and said cut-off/separating device are automatically biased towards each other and into an operative position.

19. A device according to claim 1, wherein said application element and said cut-off/separating device are biased towards each other, but kept apart from each other during operation of said device.

20. A device according to claim 1, wherein the user of said device does not have to undertake any further measure for cutting off the correction tape upon lifting said device off the application surface.

21. A device for applying on a surface a correction tape having an application side and a write-on side, said correction tape being applied in its entirety on said application surface without being fed back into said casing, said device comprising:

a casing configured for housing a stock of correction tape;

a roller extending from an aperture in said casing to press correction tape supplied from the stock on an application surface during operation of said device; and a cut-off/separating device operative upon lifting said device off said application surface and inoperative when said device is pressed against said application surface to apply said application tape;

wherein said roller is mounted on a bearing axis elastically displaceable in a direction essentially perpendicular to said application surface so that said cut-off/separating device and said roller are moved between a first inoperative position in which they are distanced from each other to a second operative position in which they are biased against each other.

22. A device according to claim 21, wherein said cut-off/separating device is positioned slightly behind a contact region of said roller on said application surface.

23. A device according to claim 21, further comprising a mechanism for advancing a cut off correction tape end from a cut-off/separating position to a contact region before use of said device.

24. A device according to claim 23, wherein said tape advancing mechanism is manually operated.

25. A device according to claim 21, wherein correction tape is guided around a portion of a circumference of said roller.

26. A device according to claim 25, wherein correction tape is guided by two guide rollers to follow said circumference of said roller.

27. A device according to claim 21, wherein said roller has a surface on which correction tape sticks in a releasable manner.

28. A device according to claim 27, wherein said surface of said roller is made of rubber or a rubber-like material.

29. A device according to claim 21, wherein said back side of said tape sticks on said roller in a releasable manner.

30. A device according to claim 21, wherein a braking force is applied to said supply of correction tape.

31. A device according to claim 30, further comprising a supply spool for a supply of correction tape, said spool having a bearing designed to exert a braking force on said spool.

32. A device according to claim 21, further comprising a spool for carrying correction tape arranged on said rear side of said casing.

33. A device according to claim 21, wherein said correction tape comprises an application layer, a write-on layer, and a reinforcing intermediate layer interposed between said application layer and said write-on layer.

34. A device according to claim 21, wherein said roller and said cut-off/separating device are automatically displaceable relative to each other.

35. A device according to claim 34, wherein:

during operation of said device, said roller and said cut-off/separating device are biased apart; and upon lifting said device off said application surface, said roller and said cut-off/separating device are automatically biased towards each other and into an operative position.

36. A device according to claim 21, wherein said roller and said cut-off/separating device are biased towards each other, but kept apart from each other during operation of said device.

37. A device according to claim 21, wherein the user of said device does not have to undertake any further measure for cutting off the correction tape upon lifting said device off the application surface.

* * * * *